US005270521A

United States Patent [19]

Shikama et al.

[11] Patent Number: 5,270,521

[45] Date of Patent: Dec. 14, 1993

[54] HEATING APPARATUS COMPRISING A PLATE-SHAPED PTC THERMISTOR ACCOMMODATED IN AN INSULATING SPACER AND TERMINAL PLATES IN SNAP-ENGAGEMENT WITH THE SPACER

[75] Inventors: Takashi Shikama; Tomoyuki Yamamoto; Kiyofumi Torii, all of Kyoto, Japan

[73] Assignee: Murata Manufacturing Co., Ltd., Japan

[21] Appl. No.: 840,033

[22] Filed: Feb. 24, 1992

[51] Int. Cl.[5] ..... H05B 1/02; H05B 3/00; H01C 7/02; F24H 3/04

[52] U.S. Cl. ..... 219/530; 219/505; 219/540; 219/541; 219/544; 338/22 R; 338/249; 338/328; 392/360; 392/379

[58] Field of Search ..... 219/505, 504, 530, 540, 219/544, 552, 553, 222-225, 541; 338/22 R, 328, 249; 392/379, 360, 347

[56] References Cited

U.S. PATENT DOCUMENTS

| | | | |
|---|---|---|---|
| 4,228,343 | 10/1980 | Kanner | 219/505 X |
| 4,341,949 | 7/1982 | Steiner et al. | 219/505 X |
| 4,814,584 | 3/1989 | Bohlender et al. | 219/505 X |
| 4,948,953 | 8/1990 | Starck | 219/541 X |
| 4,954,692 | 9/1990 | Shikama et al. | 219/530 X |

FOREIGN PATENT DOCUMENTS

| | | | |
|---|---|---|---|
| 51-109442 | 9/1976 | Japan . | |
| 53-125641 | 11/1978 | Japan | 219/505 |
| 57-183692 | 11/1982 | Japan . | |
| 64-77889 | 3/1989 | Japan | 219/540 |
| 2042856 | 9/1980 | United Kingdom | 392/347 |
| 2091070 | 7/1982 | United Kingdom | 219/544 |
| 2196844 | 5/1988 | United Kingdom | 219/222 |

*Primary Examiner*—Anthony Bartis

*Attorney, Agent, or Firm*—Ostrolenk, Faber, Gerb & Soffen

[57] ABSTRACT

In a heating apparatus including a plate-shaped positive temperature coefficient thermistor having a pair of electrode films, a pair of terminal plates of an elastic metal material are provided on the pair of electrode films of the thermistor, and there is further provided a spacer including a mounting through-hole which passes through the spacer in a thickness direction thereof. The spacer receives the thermistor in the mounting through-hole so as to position the thermistor therein between the pair of terminal plates. Each terminal plate comprises at least one extending portion extending in a longitudinal direction thereof from one portion of one end thereof, and the extending portion comprises a stopper piece which is folded toward the spacer, the stopper piece including a hook-shaped engaging stopper at an end of the stopper piece. Furthermore, the spacer comprises an engaging through-hole formed at a position corresponding to the engaging stopper of the stopper piece of each of the pair of terminal plates and the engaging through-hole passes through the spacer in the thickness direction thereof. The pair of terminal plates are elastically urged toward the pair of electrode films of the thermistor, and each engaging stopper is inserted into a corresponding engaging through-hole so as to engage in the spacer.

8 Claims, 9 Drawing Sheets

HEATING APPARATUS COMPRISING A PLATE-SHAPED PTC THERMISTOR ACCOMMODATED IN AN INSULATING SPACER AND TERMINAL PLATES IN SNAP-ENGAGEMENT WITH THE SPACER

BACKGROUND OF THE INVENTION

1. Field of the Invention

The present invention relates to a heating apparatus, and more particularly, to a heating apparatus comprising a heating device with a plate-shaped positive temperature coefficient thermistor (a positive temperature coefficient thermistor is referred to as a PTC thermistor hereinafter).

2. Description of the Prior Art

Conventionally, a PTC thermistor having a positive temperature coefficient, i.e., having such a temperature characteristic that the resistance thereof increases with increasing the temperature, has been used as an electronic circuit device, such as a temperature detecting switch which turns on or off responsive to change in the temperature, or a temperature detecting device. Further, the PTC thermistor has widely been used as a heating device for heating a fluid such as air or water.

FIGS. 1 and 2 show prior art heating units 1 and 11 for heating apparatuses for heating a fluid such as air or water, each heating unit comprising PTC thermistors 3.

Referring to FIG. 1, the heating unit 1 comprises the PTC thermistors 3 having electrode films 2 formed on both main surfaces thereof, and a pair of terminal plates 4 are provided on the respective electrode films 2 so as to be in contact with the respective electrode films 2. A pair of spacers 5 are provided between the opposing one portions of both ends of the respective terminal plates 4, wherein each spacer 5 is made of an electrically insulating material such as ceramics or resin, and the terminal plates 4 are fixed on the spacers 5 by metal rivets 6. Then, the PTC thermistors 3 are fixed between a pair of terminal plates 4. Further, lead wires 7 are respectively inserted into crimp-style lead terminals 4*a* of the respective terminal plates 4, and the lead terminals 4*a* are pressed so that the lead wires 7 are fixed therein. Thereafter, all surfaces of the heating unit 1 are covered by an electrically insulating tube or film cover (not shown and referred to as an insulating cover hereinafter), made of an electrically insulating material. Finally, a pair of heat radiating plates (not shown) are provided through the insulating cover on the respective terminal plates 4 of the heating unit 1, resulting in a conventional heating apparatus.

Referring to FIG. 2, the heating unit 11 comprises the PTC thermistors 3 inserted between a pair of terminal plates 13 which are fixed in parallel to each other using a pair of spacers 12 of an electrically insulating resin material. Respective projections 14 formed on the spacers 12 are inserted into holes (not shown in FIG. 2) formed in both ends of the respective terminal plates 13, and are deformed so as to fix the pair of terminal plates 13 on the spacers 12. The lead wires 7 are respectively inserted into crimp-style lead terminals 13*a* of the respective terminal plates 13, and the lead terminals 13*a* are pressed so that the lead wires 7 are fixed therein. Thereafter, the whole surface of the heating unit 11 is covered by an insulating cover. Finally, a pair of heat radiating plates (not shown) are provided through the insulating cover on the respective terminal plates 13 of the heating unit 11, resulting in another conventional heating apparatus.

However, since the metal rivets 6 are projected from the surfaces of the terminals plates 4 in the heating unit 1 shown in FIG. 1, there are limitations when mounting the heat radiating plate on the heating unit 1, for example, which make it difficult to mount the heating unit 1 in the heating apparatus. Further, there are such problems that the heating unit 1 has a number of parts, and also it is necessary to provide a tool for pressing the lead terminals 4*a* so as to fix the lead wires 7 therein.

Further, the heating unit 11 shown in FIG. 2 has a smaller number of parts than the heating unit 1 shown in FIG. 1. However, since only a pair of terminal plates 13 is fixed on the spacers 12, the heating unit 11 has an extremely low mechanical durability, and also the structure of the heating unit 11 becomes stable only when covering the whole unit with the insulating cover. Therefore, in the heating unit 11 shown in FIG. 2, it is necessary to cover the heating unit 11 with the insulating cover, and also, the heating unit 11 has an extremely small mechanical durability as described above.

SUMMARY OF THE INVENTION

An object of the present invention is therefore to provide a heating apparatus comprising a heating device with a plate-shaped PTC thermistor, on which a heat radiating plate can be easily mounted.

Another object of the present invention is to provide a heating apparatus comprising a heating device with a plate-shaped PT thermistor, the heating unit having a mechanical durability larger than that of the conventional heating units, resulting a high reliability.

In order to achieve the aforementioned objectives, according to the present invention, there is provided a heating apparatus comprising the following features:

The heating apparatus comprises a plate-shaped positive temperature coefficient thermistor having a pair of electrode films respectively formed on both main surfaces thereof and opposing each other.

A pair of terminal plates are respectively provided on the pair of electrode films of the thermistor, each of the terminal plates being made of an elastic metal material; and A spacer comprises a mounting through-hole which is formed in substantially the center of the spacer so as to pass through the spacer in a thickness direction thereof. The spacer mounts the thermistor in the mounting through-hole so as to position the thermistor therein between the pair terminal plates.

Each of the pair of terminal plates comprises an extending portion extending in a longitudinal direction thereof from one portion of one end thereof, and the extending portion comprises an elastic stopper piece folding toward the spacer, the stopper piece comprising an elastic hook-shaped engaging stopper at an end of the stopper piece.

The spacer comprises an engaging through-hole formed at a position corresponding to the engaging stopper of the stopper piece of each of the pair of terminal plates. Each engaging through-hole is larger than the respective stopper piece and thereby allows the engaging stopper to pass freely through the spacer in the thickness direction thereof for insertion and removal. Thus, the pair of terminal plates being elastically urged toward the pair of electrode films of the thermistor, when the engaging stopper of each of the pair of terminal plates is inserted into the engaging through-hole so as to engage in the spacer.

In the heating apparatus of the present invention, the engaging stopper of each of the pair of terminal plates is inserted into the engaging hole so as to engage in the spacer, thereby mechanically connecting the pair of terminal plates with each other through the spacer. Then, the pair of terminal plates is elastically urged onto the pair of electrode films of the thermistor so that the thermistor is kept between the pair of terminal plates.

Accordingly, the pair of electrode films is electrically connected reliably with the pair of terminal plates, respectively, and then, the pair of terminal plates is connected through the spacer so as mount the thermistor therein without requiring any connecting part such as a metal rivet or a projection. Therefore, the number of the parts of the heating apparatus becomes smaller than that of the conventional apparatus, and also the heating apparatus can be easily assembled, resulting in an inexpensive heating apparatus having a reliability higher than that of the conventional apparatus.

Furthermore, the pair of terminal plates is mechanically connected through the spacer by the engaging stopper of the engaging piece thereof in such a state that the thermistor is elastically urged onto the pair of electrode films, and also the thermistor is positioned within the spacer. Therefore, respective positions of the pair of terminal plates, the spacer and the thermistor are regulated so that they are located at predetermined positions, respectively, resulting in the heating apparatus having a mechanical strength greater than that of the conventional apparatus.

BRIEF DESCRIPTION OF THE DRAWINGS

These and other objects and features of the present invention will become clear from the following description of preferred embodiments thereof, with reference to the accompanying drawings, throughout which like parts are designated by like reference numerals, and in which.

DETAILED DESCRIPTION OF THE PREFERRED EMBODIMENTS

Preferred embodiments according to the present invention will be described below with reference to the attached drawings.

First preferred embodiment

Figure 1:
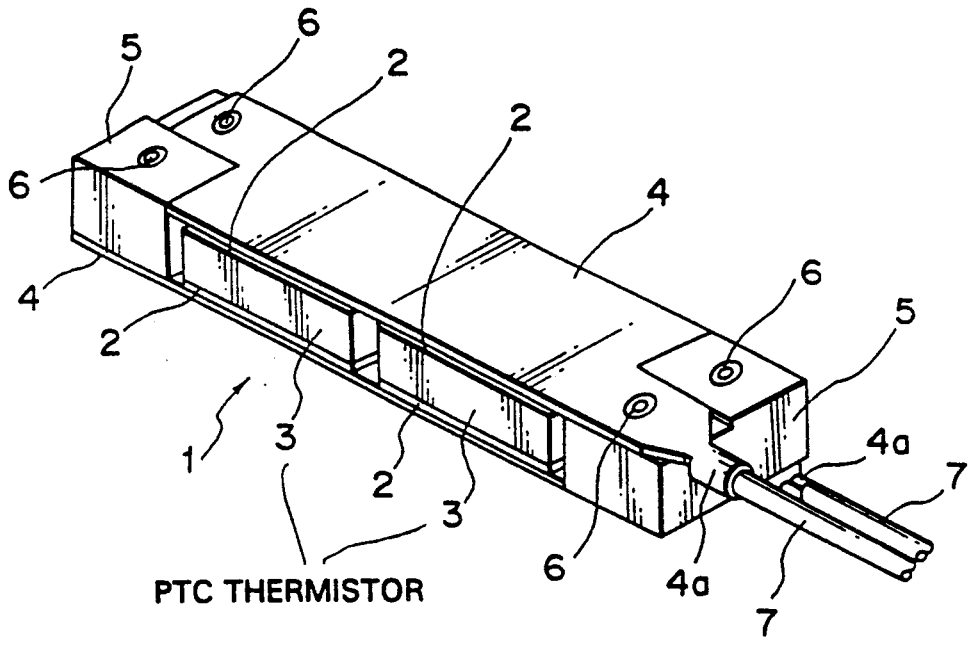
Fig. 1 PRIOR ART
FIG. 1 is a perspective view showing a structure of a conventional heating unit.
Figure 2:
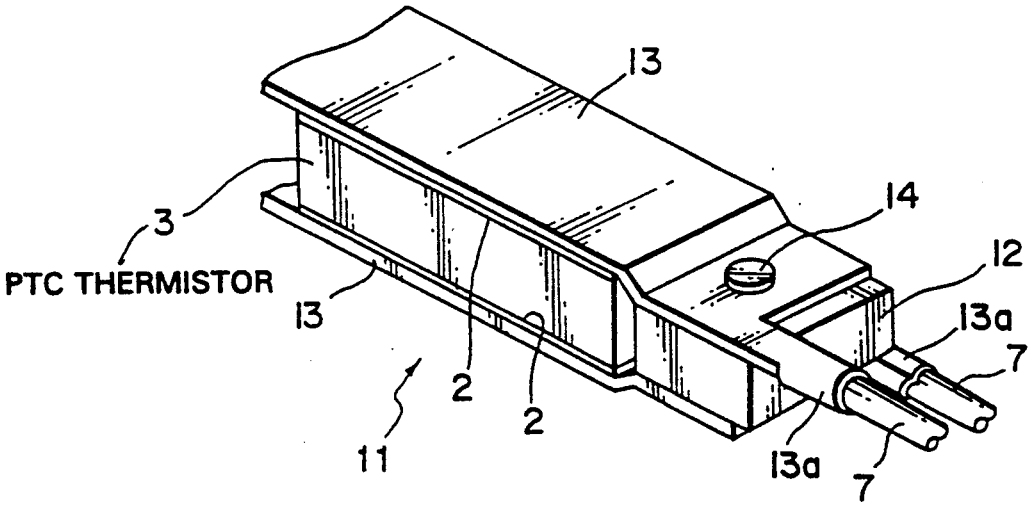
Fig. 2 PRIOR ART
FIG. 2 is a partial perspective view showing a structure of another conventional heating unit.
Figure 3:
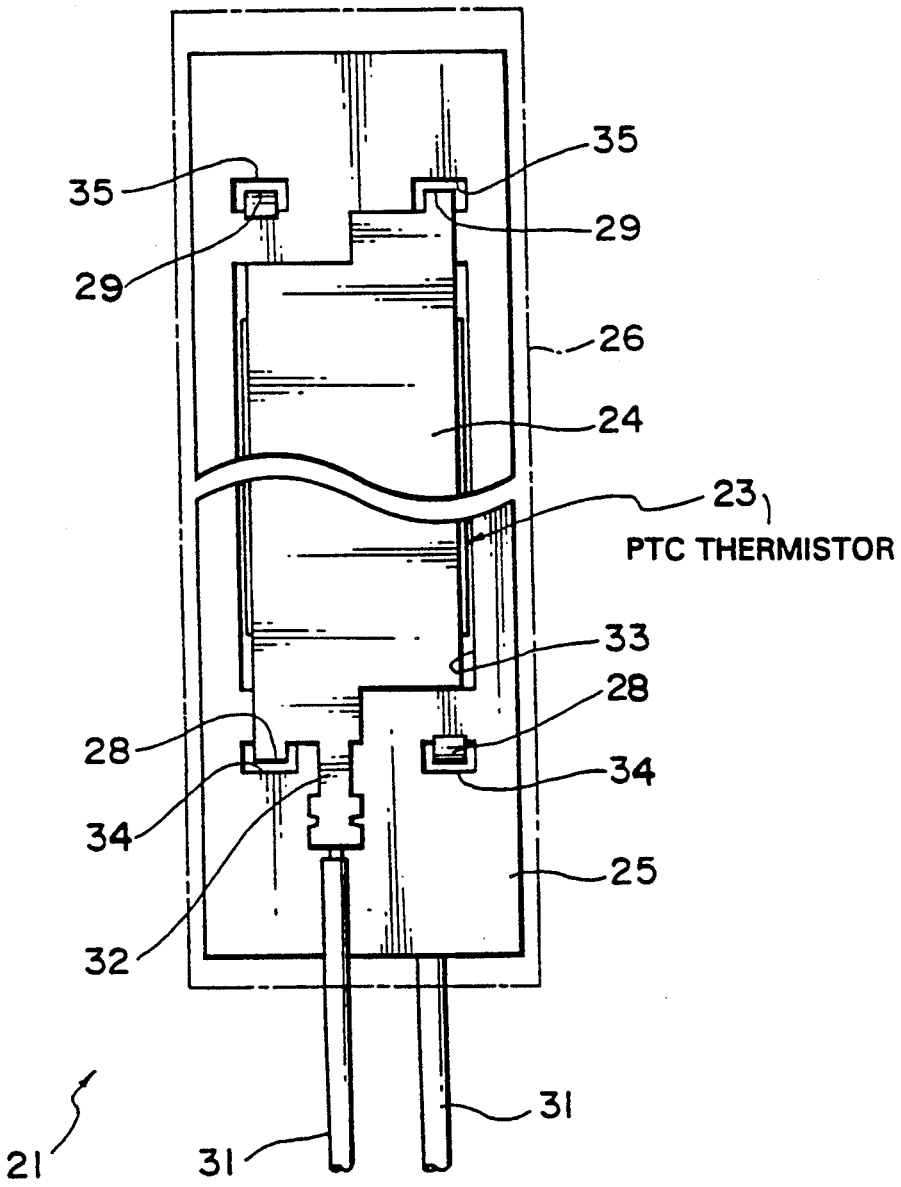
FIG. 3 is a plan view showing a structure of a heating unit according to a first preferred embodiment of the present invention.
Figure 4A:
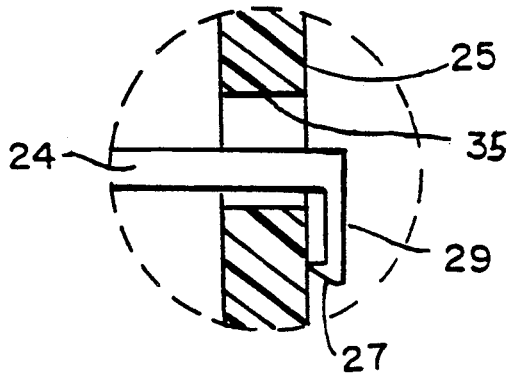
FIG. 4A is an enlarged cross-section taken through the insulating spacer around the engaging through-hole.
Figure 4:
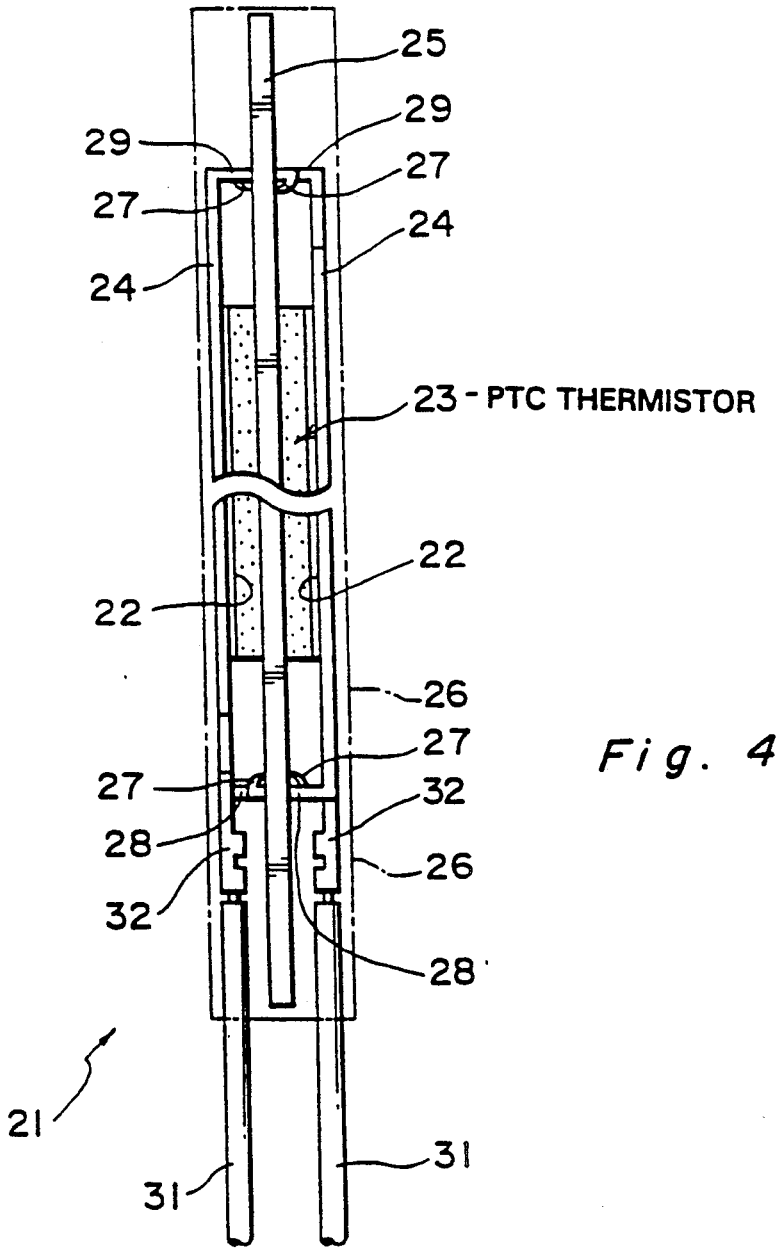
FIG. 4 is a side view showing an internal structure of the heating unit shown in FIG. 3.

FIGS. 3 and 4 show a structure of a heating unit 21 according to a first preferred embodiment of the present invention. The heating unit 21 according to the first preferred embodiment comprises a PTC thermistor 23 having a shape of a rectangular plate, on both main surfaces of which electrode films 22 are formed, a pair of terminal plates 24 for supplying electric power to the PTC thermistor 23, a spacer 25 for respectively fixing the PTC thermistor 23 and the terminal plates 24 on predetermined positions of the heating unit 21, and an insulating cover 26 for covering a pair of terminal plates 24 and the spacer 25, the insulating film cover 26 being made of an electrically insulating material such as rubber or an electrically insulating resin film. Each of the terminal plates 24 is made of an elastic metal material such as a stainless steel, BSP, phosphor bronze, or german silver.

Figure 5:
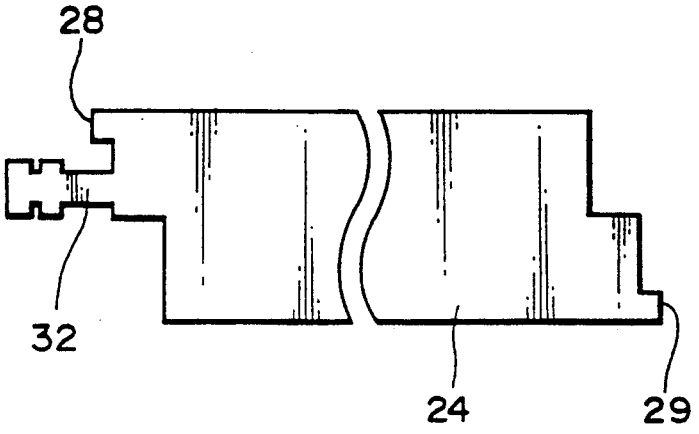
FIG. 5 is an elevation view showing a terminal plate provided in the heating unit shown in FIG. 3.
Figure 6:
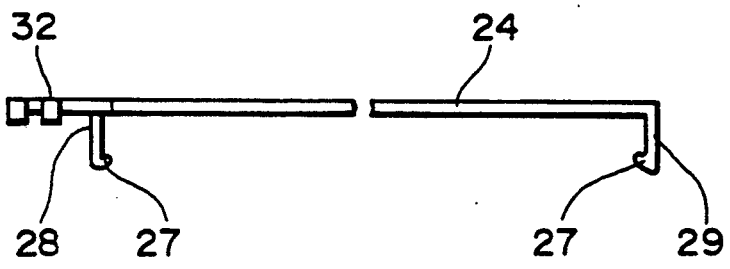
FIG. 6 is a side view showing the terminal plate shown in FIG. 5.

FIG. 5 shows a plan of each of the terminal plates 24, and FIG. 6 shows an elevation thereof. Referring to FIGS. 5 and 6, each of a pair of opposite corner portions of the respective terminal plates 24 extends in a longitudinal direction of the terminal plate 24, and is folded at a right angle. The end of each of the folded corner portions thereof is further folded so as to be in a shape of a hook, resulting in an engaging stopper 27. Then, each of the terminal plates 24 comprises stopper pieces 28 and 29 for fixing the terminal plate 24 on the spacer 25 so as to engage in the spacer 25, and a crimp-style lead terminal 32 for fixing a lead wire 31 shown in FIG. 3 thereon, which is formed so as to extend in the longitudinal direction of the terminal plate 24 from one corner portion of the terminal plate 24 adjacent to the lead terminal 32.

Figure 7:
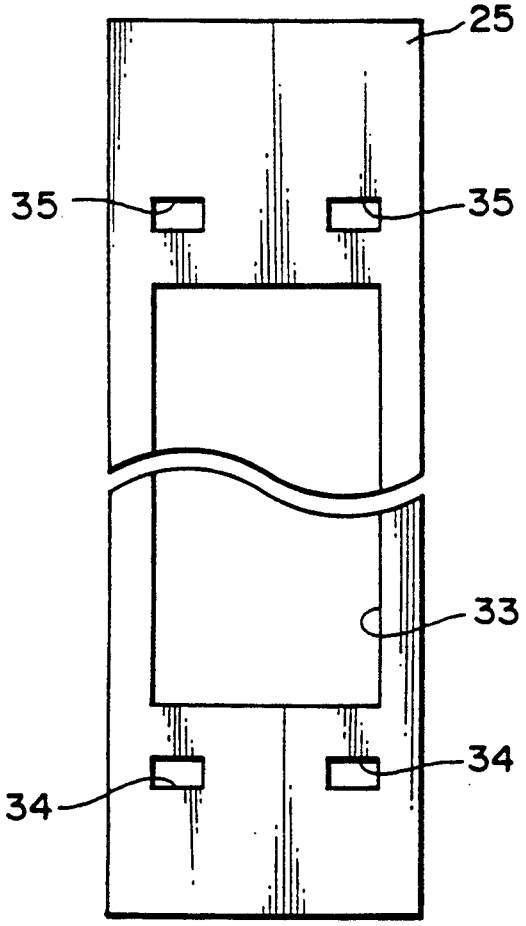
FIG. 7 is a plan view showing a spacer provided in the heating unit shown in FIG. 3.

Further, as shown in FIG. 7, the spacer 25 is made of an electrically insulating material such as a mica, a porcelain or a heat-proof resin, and has a rectangular mounting through-hole 33 formed in the center thereof which passes through the spacer 25 in a thickness direction thereof. The through-hole 33 is provided for receiving the PTC thermistor 23 in the inside thereof so as to fixedly mount it therein. Furthermore, there are formed two stopper through-holes 34 and two stopper through-holes 35 at the outsides of four corner portions of the mounting through-hole 33 so as to pass through the spacer 25 in the thickness direction thereof, and the stopper through-holes 34 and 35 are provided for receiving the stopper pieces 28 and 29 of the respective terminal plates 24 therein so as to be fixedly mounted therein.

The PTC thermistor 23 is inserted into the mounting through-hole 33 of the spacer 25. As shown in FIG. 3, lead wires 31 are mounted on the respective lead terminals 32, and then, the lead terminals 32 are pressed so that the lead wires 31 are fixed therein. The engaging stoppers 27 of the stopper pieces 28 and 29 of each of the terminal plates 24 are inserted into the stopper through-holes 34 and 35 of the spacer 25 so as to fixedly engage therein, respectively. Finally, all of these parts are covered by the insulating cover 26, resulting in the heating unit 21.

Thus, there is a hook-shaped elastically and detachably engaging stopper (e.g., 27) on a stopper piece (e.g., 29) at an end of each terminal plate (e.g., 24); and the stopper of each said terminal plate is inserted into an engaging through hole (e.g., 35), thereby being fixedly and detachably engaged in said spacer. The feature of elastic detachability is provided by the elastic metal material of each temrianl plate. The elasticity of each terminal plate permits both the terminal plate to be elastically urged against the PTC thermistor 23, and the terminal plate to be elastically detached from the insulating spacer (e.g., 25) in which the PTC thermistor is held.

In particular, the stoppers 27 are hook-shaped and are on stopper pieces 28, 29 made of elastic material. When the stoppers are inserted into the corresponding engaging through holes 34, 35, then the stopper pieces are fixedly engaged in the spacer, without any need to fold or crimp the ends of the stopper pieces after making the engagements, since each stopper 27 has a shape of a hook and thereby elastically grips the insulating spacer 25 after passing through the engaging through hole.

Further, as is apparent from FIGS. 3, 6 and 7, the holes 34, 35 are larger than the stopper pieces 28, 29 and therefore permit the stopper pieces 28, 29 to move with the terminal plate 24 when the terminal plate is moved in its longitudinal direction. By such a longitudinal movement, one of the resilient stopper pieces e.g., 28) will be flexed, and the engaging stopper 27 of the other stopper piece (e.g., 29) will e moved in a direction parallel to the surface of the spacer 25, and in that way, will disengage from the spacer 25. Thus the stopper 27 of the stopper piece 29 can be detached elastically from the spacer 25.

In the heating unit 21 constructed as described above, the engaging stoppers 27 of the engaging pieces 28 and 29 of the respective terminal plates 24 are fixedly engaged with the peripheries of the stopper through-holes 34 and 35 of the spacer 25, and thus, the engaging stoppers 27 are prevented from being disconnected or coming off the spacer 25. Further, the pair of terminal plates 24 are connected through the spacer 25 with each other so as to be in elastic contact with the electrode films 22 of the PTC thermistor 23 in such a state that the pair of terminal plates 24 are elastically pressed or urged onto them. As a result, the PTC thermistor 23 is fixedly mounted between the pair of terminal plates 24. Therefore, the pair of terminal plates 24 are reliably electrically connected with the electrode films 22 of the PTC thermistor 23, respectively.

Further, the pair of terminal plates 24 are mechanically connected through the spacer 25 with each other by the stopper pieces 28 in such a state that the terminal plates 24 are respectively pressed onto the electrode films 22 of the PTC thermistor 23, thereby positioning and mounting the PTC thermistor 23 in the spacer 25 between the pair of terminal plates 24. As a result, respective positions of the pair of terminal plates 24, the spacer 25 and the PTC thermistor 23 are regulated so that they are located at predetermined positions, respectively, resulting in a mechanical strength greater than that of each of the conventional heating units 1 and 11.

In the above-mentioned heating unit 21, a pair of terminal plates 24 are electrically connected with both the main surfaces of the PTC thermistor 23, respectively. When electric power is supplied through the pair of terminal plates 24 to the PTC thermistor 23, the PTC thermistor 23 generates heat. The heat generated by the PTC thermistor 23 is transferred through the electrode films 22 onto the terminal plates 24, respectively. Therefore, the terminal plates 24 become heating surfaces of the heating unit 21.

Figure 8:
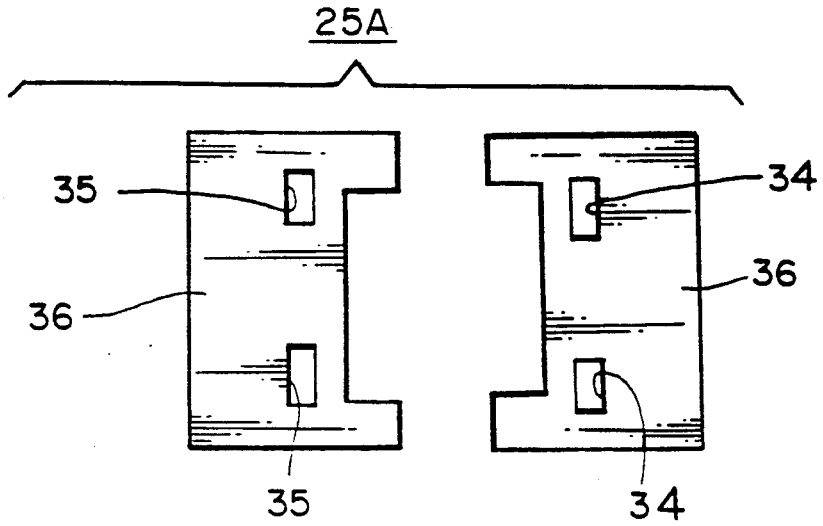
FIG. 8 is a plan view showing a spacer of a modification provided in the heating unit shown in FIG. 3.

In the above-mentioned first preferred embodiment, the pair of terminal plates 24 are mechanically connected through the spacer 25 with each other, and the PTC thermistor 23 is positioned in the inside thereof. Therefore, alternatively, instead of the spacer 25, there may be used a spacer 25A a shape shown in FIG. 8, which is formed by dividing the spacer 25 into two divided spacer portions 36, so that one divided spacer portion is separated from another divided spacer portion, for example, by cutting the middle portion of the spacer 25.

Second preferred embodiment

Figure 9:
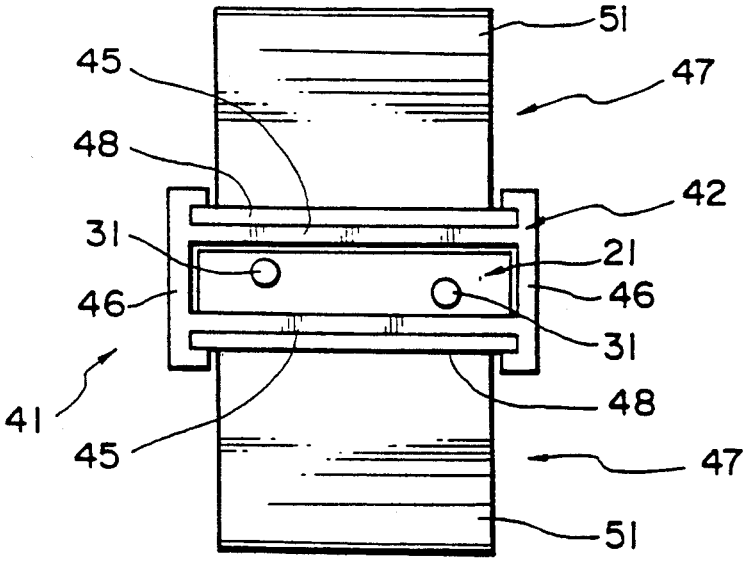
FIG. 9 is a side view showing a heating apparatus for a hot air type heater according to a second preferred embodiment of the present invention, the heating apparatus comprising the heating unit shown in FIG. 3.
Figure 10:
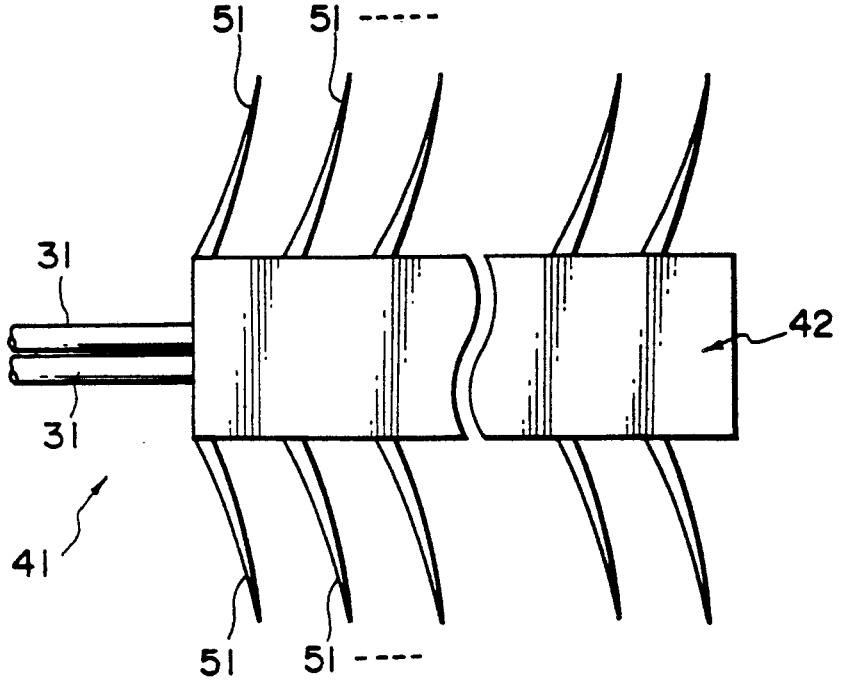
FIG. 10 is an elevation view showing the heating apparatus shown in FIG. 9.

FIGS. 9 and 10 show a heating apparatus 41 for a hot air type heater according to a second preferred embodiment of the present invention, wherein the heating apparatus comprises the heating unit 21. The heating apparatus 41 according to the second preferred embodiment is characterized in incorporating the heating unit 21 having the above-mentioned structure in the inside of a metal case 42 of a highly thermally conductive metal such as aluminum, and heat radiating plates 47 are mounted on the metal case 42.

Figure 11:
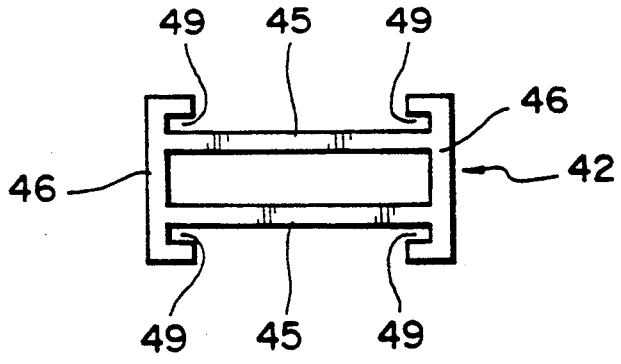
FIG. 11 is a side view showing a metal case provided in the heating unit apparatus shown in FIG. 9.

The metal case 42 has a cross section shown in FIG. 11, and comprises a of plate portions 45 which are respectively in contact with a pair of terminal plates 24 of the heating unit 21 shown in FIGS. 3 and 4, and connection portions 46 for connecting one plate portion 45 with another plate portion 45, each connection portion 46 having a height substantially equal to the thickness of the heating unit 21. Each of the connection portions 46 of the metal case 42 has a width larger than the sum of an interval between a pair of plate portions 45 and the thicknesses of the respective plate portions 45. Both side portions of the connection portions 46 are respectively folded over the plate portions 45, thereby forming mounting channels 49 between the respective plate portions 45, and folded parts of the connection portions 46, for mounting both side portions of the metal plate 48 constituting a base of each of heat radiating plates 47 shown in FIGS. 12 and 13.

Figure 12:
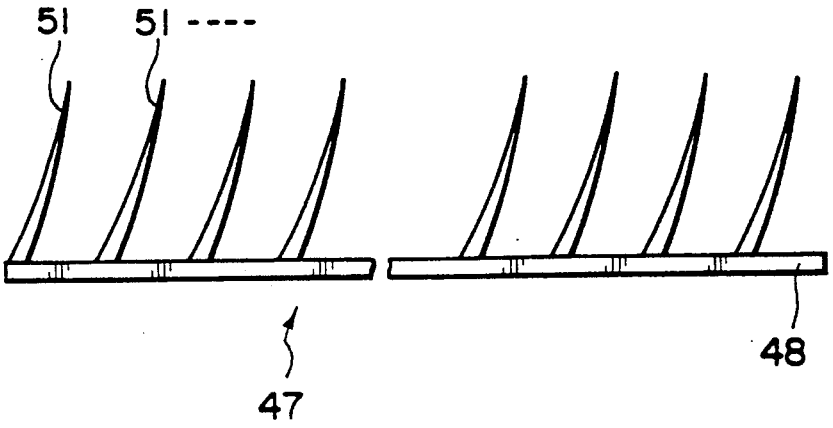
FIG. 12 is an elevation view showing a heat radiating plate provided in the heating apparatus shown in FIG. 9.
Figure 13:
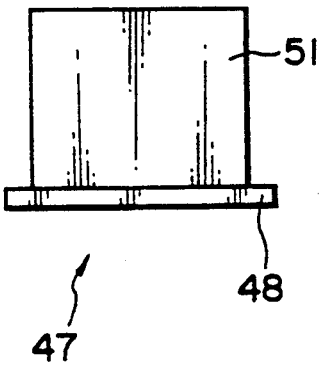
FIG. 13 is a side view showing the heat radiating plate shown in FIG. 12.

As shown in FIGS. 12 and 13, each of the heat radiating plates 47 is made of a piece of metal plate 48 having a predetermined width, which is made of a highly thermally conductive metal material such as aluminum or copper. On one main surface of the metal plate 48 of each of the heat radiating plates 47, there are formed a number of tongue-shaped fins 51 each having a width smaller than that of the metal plate 48 with substantially the predetermined equal space using a cutting and raising method.

Side portions of the respective heat radiating plates 47 are respectively put into side portions of the mounting channels 49 formed on both sides of the respective plate portions 45, and then, the heat radiating plates 47 are slid in the mounting channels 49 toward the inside thereof, so as to be fixedly mounted on the respective plate portions 45 and to be in contact with the respective plate portions 45.

In the heating apparatus 41 according to the second preferred embodiment, heat generated by the heating unit 21 is transferred through the plate portions 45 of the metal case 42 onto the metal plates 48 of the respective heat radiating plates 47, and further, is transferred from the metal plates 48 to the respective tongue-shaped fins 51.

Third preferred embodiment

Figure 14:
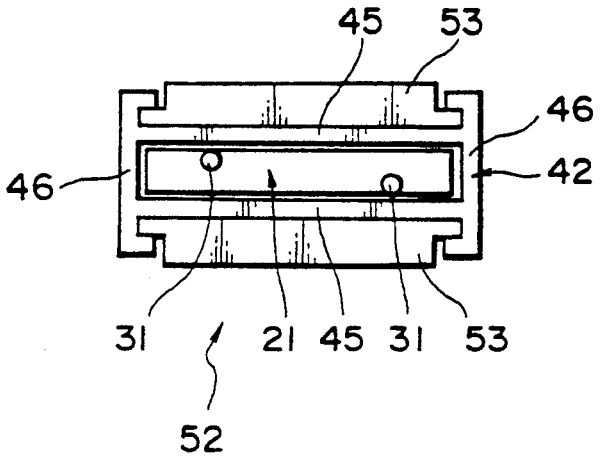
FIG. 14 is a side view showing a plate type heating apparatus according to a third preferred embodiment of the present invention, the plate type heating apparatus comprising the heating unit shown in FIG. 3.
Figure 15:
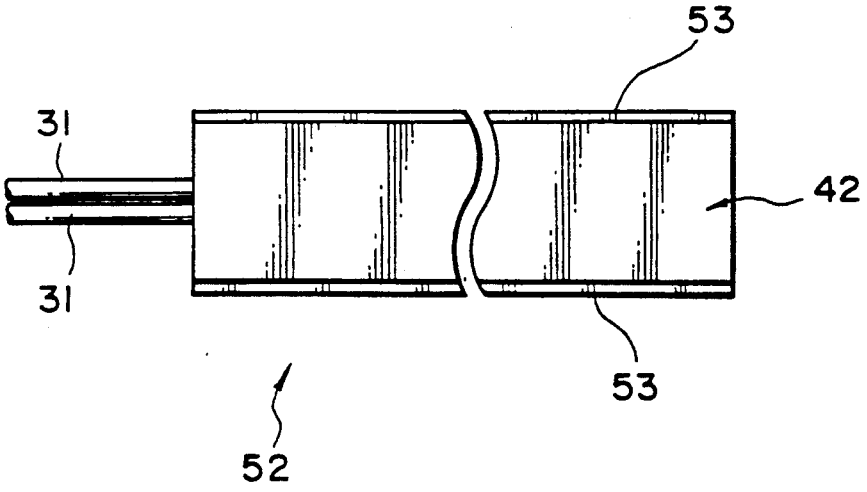
FIG. 15 is an elevation view showing the plate type heating apparatus shown in FIG. 14.

FIGS. 14 and 15 show a plate heater 52 comprising the above-mentioned heating unit 21 according to a third preferred embodiment of the present invention. In FIGS. 14 and 15, portions corresponding to those shown in FIGS. 12 and 13 are designated by the corresponding reference numerals, and the duplicated description is omitted therein.

The plate heater 52 according to the third preferred embodiment is characterized in that there are mounted flat plate type heat radiating plates 53 on the metal case 42 in the heating apparatus 41 shown in FIGS. 12 and 13, in stead of the heat radiating plates 43 having the tongue-shaped fins 51.

In the plate heater 52 of the present preferred embodiment, heat generated by the heating unit 21 is transferred through the plate portions 45 of the metal case 42 onto the flat plate type heat radiating plates 53 so as to heat the heat radiating plates 53.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A heating apparatus comprising:

a plate-shaped positive temperature coefficient thermistor having a pair of electrode films respectively formed on both main surfaces thereof opposing each other;

a pair of terminal plates respectively provided on said pair of electrode films of said thermistor, each of said terminal plates being made of an elastic metal material; and a spacer comprising a mounting through-hole formed in substantially the center of said spacer so as to pass through said spacer in a thickness direction thereof, said spacer receiving said thermistor in said mounting through-hole so as to position said thermistor therein between said pair of terminal plates;

wherein each of said pair of elastic metal terminal plates comprises a pair of extending portions extending a longitudinal direction thereof from respective spaced-apart end portions thereof, and each said extending portion comprises a stopper piece folded toward said spacer, said stopper piece comprising a hook-shaped elastically detachable engaging stopper at and end of said stopper piece; and said spacer comprises a pair of engaging through-holes formed a respective spaced-apart positions corresponding to and receiving said elastically detachable engaging stoppers of said stopper pieces of each of said terminal plates;

said engaging through-holes passing through said spacer in the thickness direction thereof and being larger than the corresponding stoppers so as to allow the stoppers to move freely through the through-holes, said elastically detachable engaging stopper of each of said pair of terminal plates being inserted into said corresponding engaging through-hole and elastically engaging said engaging through-hole, the terminal plates being longitudinally slidable against the elastic bias of one of the stopper pieces so as to sallow the negating stopper on the other stopper piece to be brought into alignment with the corresponding engaging through-hole for removal from that through-hole and insertion into that through-hole, thereby fixedly and detachably engaging said terminal plates with said spacer and elastically urging said pair of terminal plates toward said pair of electrode films of said thermistor.

2. The apparatus as claimed in claim 1, further comprising an electrically insulating cover for covering the whole heating apparatus.

3. The apparatus as claimed in claim 2, further comprising:

a metal case for incorporating said heating apparatus therein; and metal heat radiating means provided on said metal case, said heat radiating means transferring heat generated by said thermistor to the outside thereof.

4. The apparatus as claimed in claim 3, wherein said heat radiating means comprises a plurality of fins.

5. The apparatus as claimed in claim 3, wherein said heat radiating means is a flat plate type heat radiating plate.

6. The apparatus as claimed in claim 1, wherein said spacer is comprised of to divided separate portions.

7. A heating apparatus comprising:

a plate-shaped positive temperature coefficient thermistor having a pair of electrode films respectively formed on both main surfaces thereof opposing each other;

a pair of terminal plates respectively provided on said pair of electrode films of said thermistor, each of said terminal plates being made of an elastic metal material; and a spacer comprising a mounting through-hole formed in said spacer and passing through said spacer in a thickness direction thereof, said spacer receiving said thermistor in said mounting through-hole so as to position said thermistor in said mounting through-hole and between said pair of terminal plates;

wherein each said elastic metal terminal plate comprises a pair of elastic portions having hook-shaped elastically engaging stoppers at their ends, and which are integrally formed on the terminal plate at opposite ends thereof; and said spacer comprises a pair of engaging through-holes formed at positions corresponding to said elastically engaging stoppers, said engaging through-holes passing through said spacer in the thickness direction thereof, said elastic portions and elastically engaging stoppers of said terminal plate being inserted into said corresponding engaging through-holes for elastically engaging said through-holes, said engaging through-holes being larger than the stoppers so as to allow the stoppers to move freely therethrough, the terminal plates being longitudinally slidable against the elastic bias of one of the stopper pieces so as to allow the engaging stopper on the other stopper piece to be brought into alignment with the corresponding engaging through-hole for removal from that through-hole and insertion into that through-hole, thereby elastically and detachably engaging said terminal plates with said spacer, and elastically urging said pair of terminal plates toward said pair of electrode films of said thermistor.

8. A heating apparatus comprising:

a plate-shaped positive temperature coefficient thermistor having a pair of electrode films respectively formed on both main surfaces thereof opposing each other;

a pair of temrianl plates respectively provided on said pair of electrode films of said thermistor, each of said terminal plates being made of an elastic metal material; and a spacer comprising amounting through-hole formed in substantially the center of said spacer so as to pass through said spacer in a thickness direction thereof, said spacer receiving said thermistor in said mounting through-hole so as to position said thermistor therein between said pair of terminal plates;

wherein each of said pair of elastic metal terminal plates comprises elastic metal engaging means for fixedly and detachably attaching said terminal plates to said spacer, with said pair of terminal plates being elastically urged toward said pair of electrode films of said thermistor;

each said engaging means comprising a pair of extending portions of the corresponding elastic metal terminal plate which extend in a longitudinal direction from opposite ends of said terminal plate;

each said extending portion comprises a stopper piece which is filed toward said spacer, said stopper piece having a hook-shaped engaging stopper formed at lane end of said stopper piece; and said spacer comprises an engaging through-hole formed at a position corresponding to each said engaging stopper of each of said pair of terminal plates so as to pass through said spacer in the thickness direction thereof, said engaging through-holes being larger than the stoppers so as to allow the stoppers to move freely therethrough, each said engaging stopper of each of said pair of terminal plates being inserted into said corresponding engaging through-hole, thereby being fixedly engaged in said spacer, and each said temrianl plate being detachable from said spacer by moving said terminal plate in said longitudinal direction, thereby flexing one of said elastic metal stopper pieces and simultaneously disengaging the other of said stopper pieces from said spacer.

* * * * *